US010933637B2

(12) United States Patent
Yamazaki

(10) Patent No.: US 10,933,637 B2
(45) Date of Patent: Mar. 2, 2021

(54) LIQUID JET HEAD AND LIQUID JET RECORDING DEVICE FOR ACCOMODATING VARIOUS INK TYPES

(71) Applicant: SII Printek Inc., Chiba (JP)

(72) Inventor: Shunsuke Yamazaki, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 16/531,886

(22) Filed: Aug. 5, 2019

(65) Prior Publication Data

US 2020/0047499 A1 Feb. 13, 2020

(30) Foreign Application Priority Data

Aug. 10, 2018 (JP) ..... JP2018-151729

(51) Int. Cl.
*B41J 2/14* (2006.01)
*B41J 2/16* (2006.01)

(52) U.S. Cl.
CPC ..... *B41J 2/1433* (2013.01); *B41J 2/14209* (2013.01); *B41J 2/14* (2013.01); *B41J 2/1609* (2013.01)

(58) Field of Classification Search
CPC ..... B41J 2/1433; B41J 2/14209; B41J 2/14; B41J 2002/14491; B41J 2/1609; B41J 2/1632; B41J 2/1623; B41J 2002/14362
See application file for complete search history.

(56) References Cited

U.S. PATENT DOCUMENTS

2007/0006727 A1 1/2007 Gysling
2015/0029269 A1 1/2015 Domae
2018/0086065 A1* 3/2018 Yamazaki ..... B41J 2/14209

FOREIGN PATENT DOCUMENTS

EP 3300895 A1 4/2018
JP 2010208224 A 9/2010
JP 2015-024516 A 2/2015
JP 2018-051937 A 4/2018

OTHER PUBLICATIONS

Extended European Search Report in Europe Application No. 19190932.4, dated Jan. 7, 2020, 7 pages.

* cited by examiner

*Primary Examiner* — Henok D Legesse
(74) *Attorney, Agent, or Firm* — Brinks Gilson & Lione

(57) ABSTRACT

There is provided a liquid jet head and a liquid jet recording device capable of increasing available ink types. The liquid jet head according to an embodiment of the present disclosure is provided with an actuator plate having a plurality of ejection grooves, a nozzle plate having nozzle holes communicated with the ejection grooves, and a nozzle guard having a rib adapted to support the nozzle plate, and a communication hole adapted to communicate each of the first nozzle holes and an outside with each other. The rib has contact with the nozzle plate at a position which fails to be opposed to an opening on the nozzle plate side of each of the ejection grooves.

10 Claims, 8 Drawing Sheets

LIQUID JET HEAD AND LIQUID JET RECORDING DEVICE FOR ACCOMODATING VARIOUS INK TYPES

RELATED APPLICATIONS

Priority is claimed on Japanese Patent Application No. 2018-151729, filed on Aug. 10, 2018, the content of which is incorporated herein by reference.

BACKGROUND OF THE INVENTION

1. Field of the Invention

The present disclosure relates to a liquid jet head and a liquid jet recording device.

2. Description of the Related Art

A liquid jet recording device for performing a variety of types of printing is generally known. A liquid jet head of such a device is supplied with ink from a liquid container via a liquid supply pipe, and ejects the ink from nozzle holes of the liquid jet head toward the recording target medium. Thus, characters and images are recorded on the recording target medium.

Further, the liquid jet head is generally provided with a nozzle plate provided with the nozzle holes, and an actuator plate having a plurality of channels communicated with the nozzle holes. Each of the channels of the actuator plate is filled with the ink.

In the liquid jet head, when a voltage is applied to the actuator plate, the capacity of the channel varies. The ink is ejected from the nozzle hole using this variation.

The liquid jet head configured in such a manner is attached to a scanning device via a nozzle guard in some cases (see, e.g., JP-A-2018-051937 (PLT1), JP-A-2015-24516 (PLT2)). When attaching such a liquid jet head to the scanning device, the nozzle plate and the nozzle guard am bonded to each other.

Incidentally, in the liquid jet head, the nozzle plate is separated from the actuator plate, or a crack occurs in the actuator plate due to a stress caused by the heat when ejecting the ink in some cases. In such cases, when using the ink having electrical conductivity, there is a possibility that electrical short circuit occurs. As described above, in the related art, there is a problem that it is not easy to increase available ink types such as the ink having electrical conductivity. Therefore, it is desirable to provide the liquid jet head and the liquid jet recording device capable of increasing the available ink types.

SUMMARY OF THE INVENTION

The liquid jet head according to an embodiment of the present disclosure is provided with an actuator plate having a plurality of ejection grooves, a nozzle plate having nozzle holes communicated with the ejection grooves, and a nozzle guard having a rib adapted to support the nozzle plate, and a communication hole adapted to communicate each of the first nozzle holes and an outside with each other. The rib has contact with the nozzle plate at a position which fails to be opposed to an opening on the nozzle plate side of each of the ejection grooves.

A liquid jet recording device according to an embodiment of the disclosure is provided with the liquid jet head described above, and a containing section adapted to contain a liquid to be supplied to the liquid jet head.

According to the liquid jet head and the liquid jet recording device related to an embodiment of the disclosure, it is possible to increase the available ink types.

DETAILED DESCRIPTION OF THE PREFERRED EMBODIMENTS

An embodiment of the present disclosure will hereinafter be described in detail with reference to the drawings. It should be noted dial the description will lie presented in the following order.

1. Embodiment (Inkjet Head, Printer)
2. Modified Example (Inkjet Head)

1. EMBODIMENT

[Overall Configuration of Printer 1]

Figure 1:
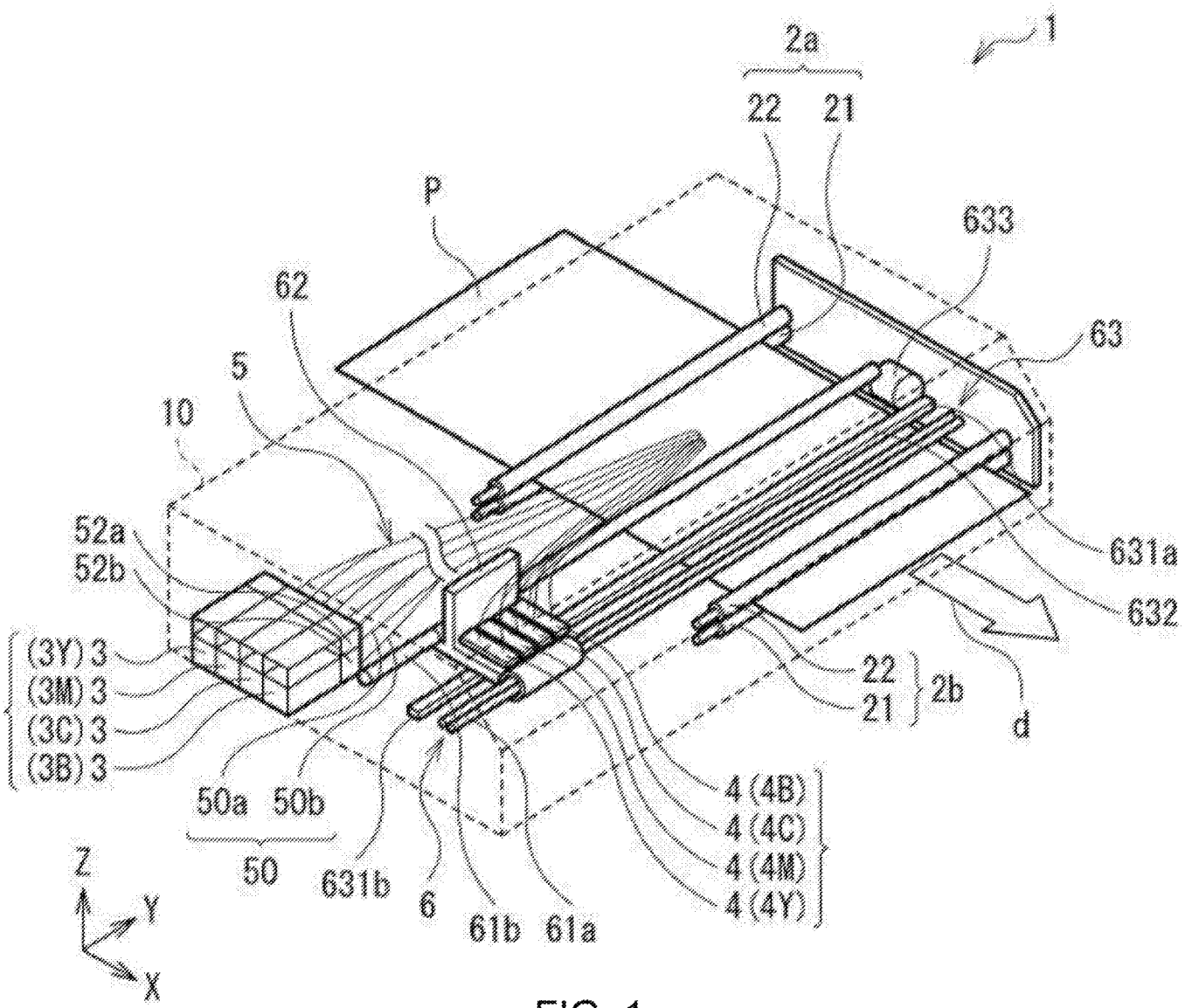
FIG. 1 is a schematic perspective view showing a schematic configuration example of a liquid jet recording device according to an embodiment of the present disclosure.

FIG. 1 is a perspective view schematically showing a schematic configuration example of a printer 1 according to an embodiment of the present disclosure. The printer 1 corresponds to a specific example of the "liquid jet recording device" in the present disclosure. The printer 1 is an inkjet printer for performing recording (printing) of images, characters, and so on, on recording paper P as a recording target medium using ink 9 described later. Although the details will be described later, the printer 1 is also an ink circulation type inkjet printer using the ink 9 being circulated through a predetermined flow channel.

As shown in FIG. 1, the printer 1 is provided with a pair of carrying mechanisms 2*a*, 2*b*, ink tanks 3, inkjet heads 4, a circulation mechanism 5 and a scanning mechanism 6. These members are housed in a housing 10 having a predetermined shape. It should be noted that the scale size of each of the members is accordingly altered so that the member is shown large enough to recognize in the drawings used in the description of the specification. The inkjet heads 4 (inkjet heads 4Y, 4M, 4C and 4B described later) correspond to a specific example of a "liquid jet head" in the present disclosure.

(Carrying Mechanisms 2*a*, 2*b*)

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is configured using, for example, a motor.

(Ink Tanks 3)

The ink tanks 3 are each a tank for containing the ink 9 to be supplied to the corresponding inkjet head A. The ink 9 corresponds to a specific example of the "liquid" in the present disclosure. The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10. It should be noted that the ink tanks 3Y, 3M, 3C, and 3B have the same configuration except the color of the ink 9 contained, and are therefore collectively referred to as ink tanks 3 in the following description.

(Inkjet Heads 4)

The inkjet heads 4 are each a head for jetting (ejecting) the ink 9 shaped like a droplet from a plurality of nozzle holes (nozzle holes H1, H2) described later to the recording paper P to thereby perform recording of images, characters, and so on. As the ink jet heads 4, there are also disposed 4 types of heads for individually jetting the 4 colors of ink 9 respectively contained by the ink tanks 3Y, 3M, 3C and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C and 4B are arranged side by side along the Y-axis direction inside the housing 10.

It should be noted that the inkjet heads 4Y, 4M, 4C and 4B have the same configuration except the color of the ink 9 used therein, and are therefore collectively referred to as inkjet heads 4 in the following description. Further, the detailed configuration of the inkjet heads 4 will be described later (FIG. 3 through FIG. 8).

(Circulation Mechanism 5)

Figure 2:
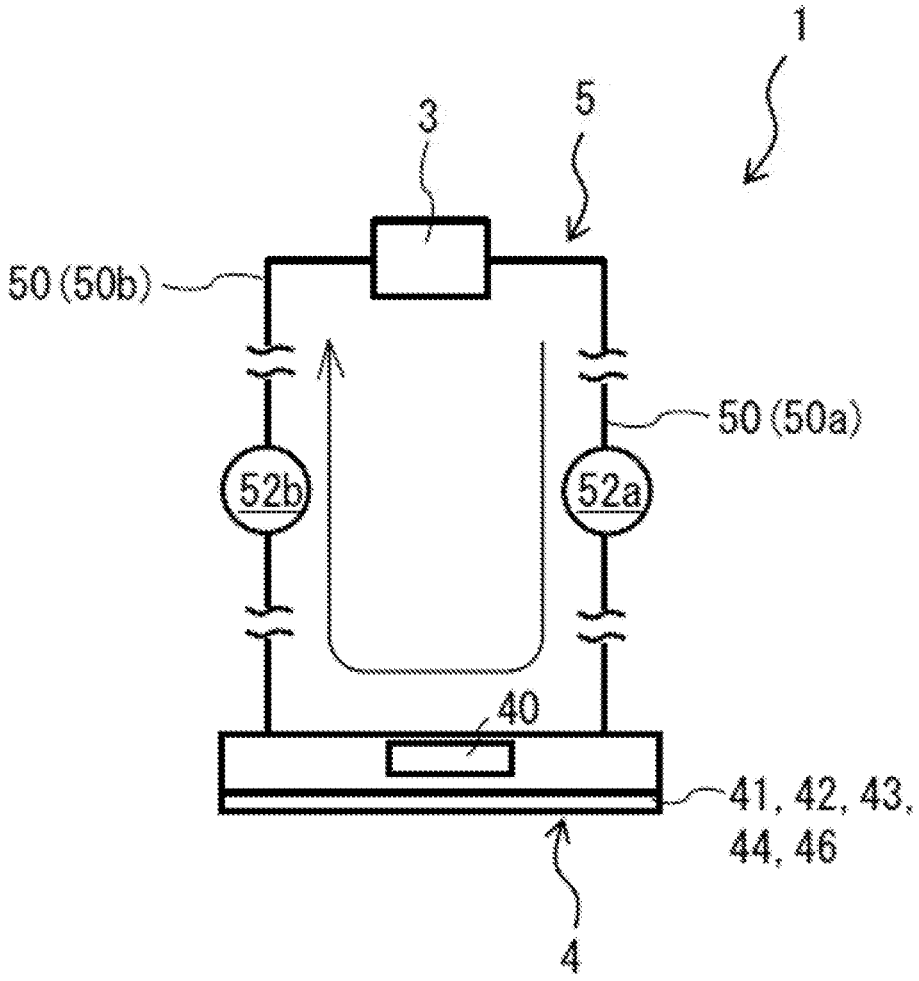
FIG. 2 is a schematic diagram showing a detailed configuration example of a circulation mechanism and so on shown in FIG. 1.

The circulation mechanism 5 is a mechanism for circulating the ink 9 between the inside of the ink tanks 3 and the inside of the inkjet heads 4. FIG. 2 is a diagram schematically showing a configuration example of the circulation mechanism 5 together with the ink tanks 3 and the inkjet heads 4. It should be noted that the solid arrow described in FIG. 2 indicates the circulation direction of the ink 9. As shown in FIG. 2, the circulation mechanism 5 is provided with predetermined flow channels (circulation channels 50) for circulating the ink 9, and pairs of liquid feeding pumps 52*a*, 52*b*.

The circulation channels 50 are each a flow channel of circulating between the inside of the inkjet head 4 and the outside (the inside of the ink tank 3) of the inkjet head 4, and are arranged that the ink 9 circularly flows through the circulation channel 50. The circulation channels 50 each have, for example, a flow channel 50*a* as a part extending from the ink tank 3 to the inkjet head 4, and a flow channel 50*b* extending from the inkjet head 4 to the ink tank 3. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3.

The liquid feeding pump 52*a* is disposed on the flow channel 50*a* between the ink tank 3 and the inkjet head 4. The liquid feeding pump 52*a* is a pump for feeding the ink 9 contained inside the ink tank 3 to the inside of the inkjet head 4 via the flow channel 50*a*. The liquid feeding pump 52*b* is disposed on the flow channel 50*b* between the inkjet head 4 and the ink tank 3. The liquid feeding pump 52*b* is a pump for feeding the ink 9 contained inside the inkjet head 4 to the inside of the ink tank 3 via the flow channel 50*b*.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 has a pair of pulleys 631*a*, 631*b* disposed between the guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is coupled the carriage 62. On the carriage 62, the four types of inkjet heads 4Y, 4M, 4C and 4B described above are disposed so as to be arranged side by side along the Y-axis direction. It should be noted that such a scanning mechanism 6 and the carrying mechanisms 2*a*, 2*b* described above constitute a moving mechanism for moving the inkjet heads 4 relatively to the recording paper P.

[Detailed Configuration of Inkjet Heads 4]

Figure 3:
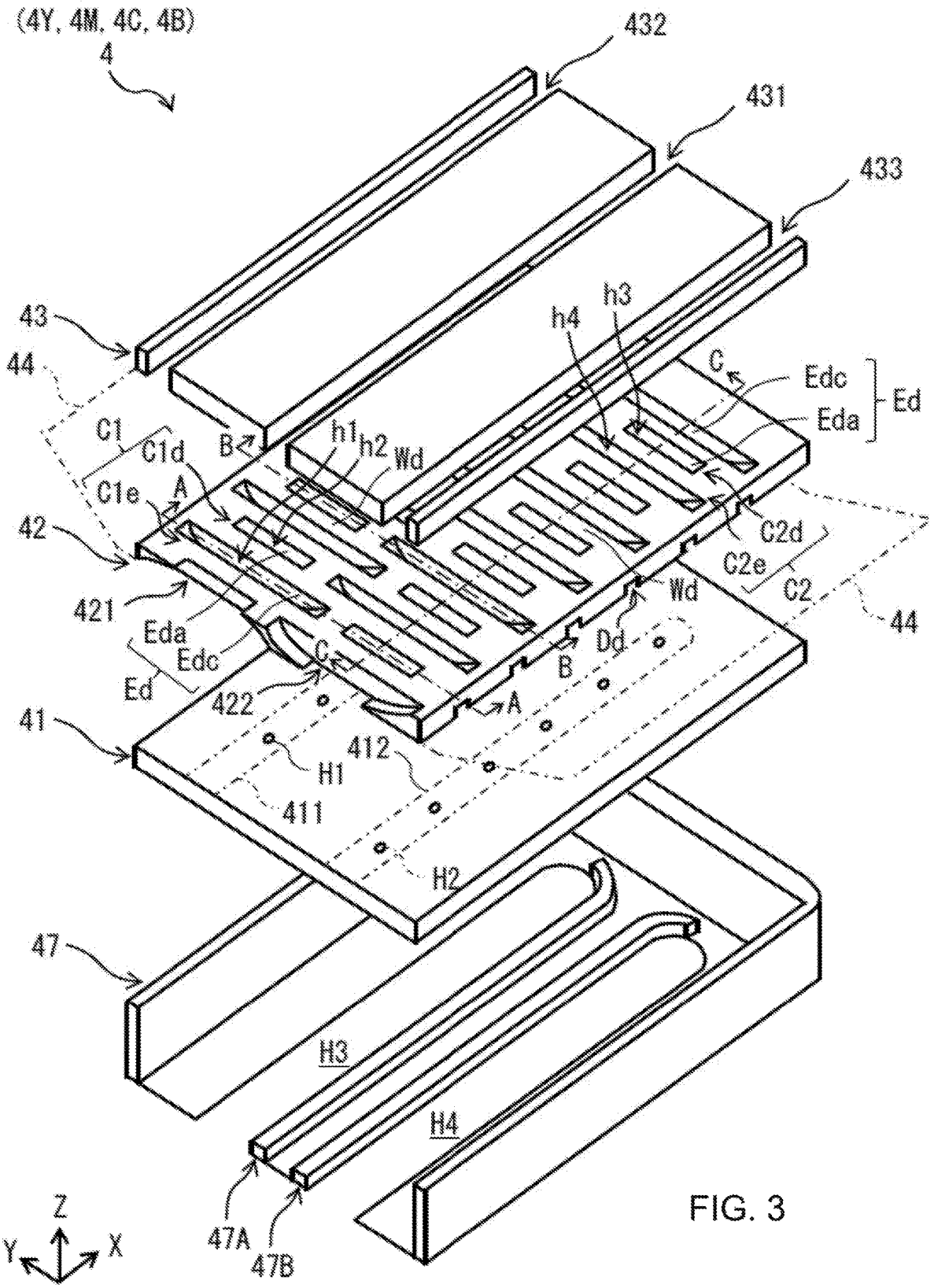
FIG. 3 is an exploded perspective view showing a detailed configuration example of the liquid jet head shown in FIG. 2.
Figure 4:
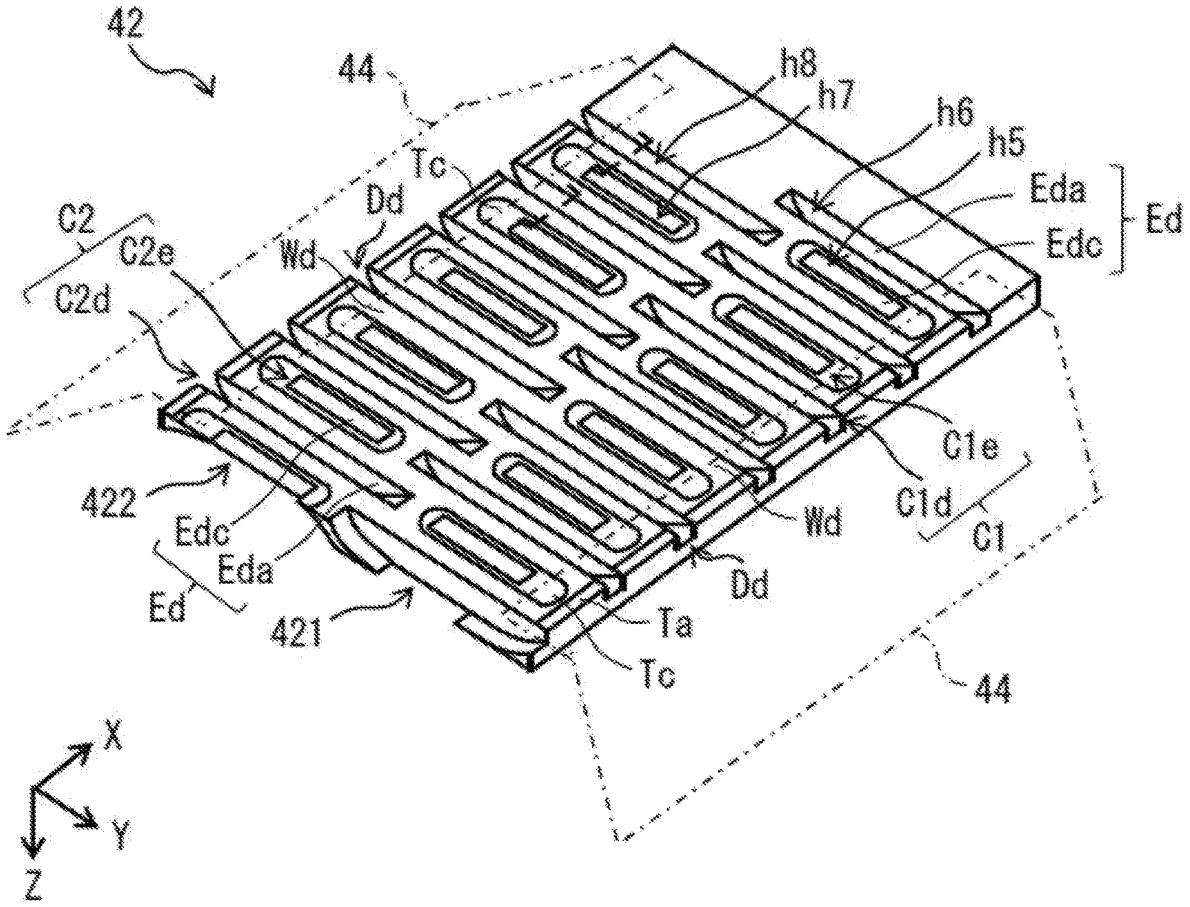
FIG. 4 is a perspective view showing a configuration example of a reverse surface of the actuator plate shown in FIG. 3.
Figure 5:
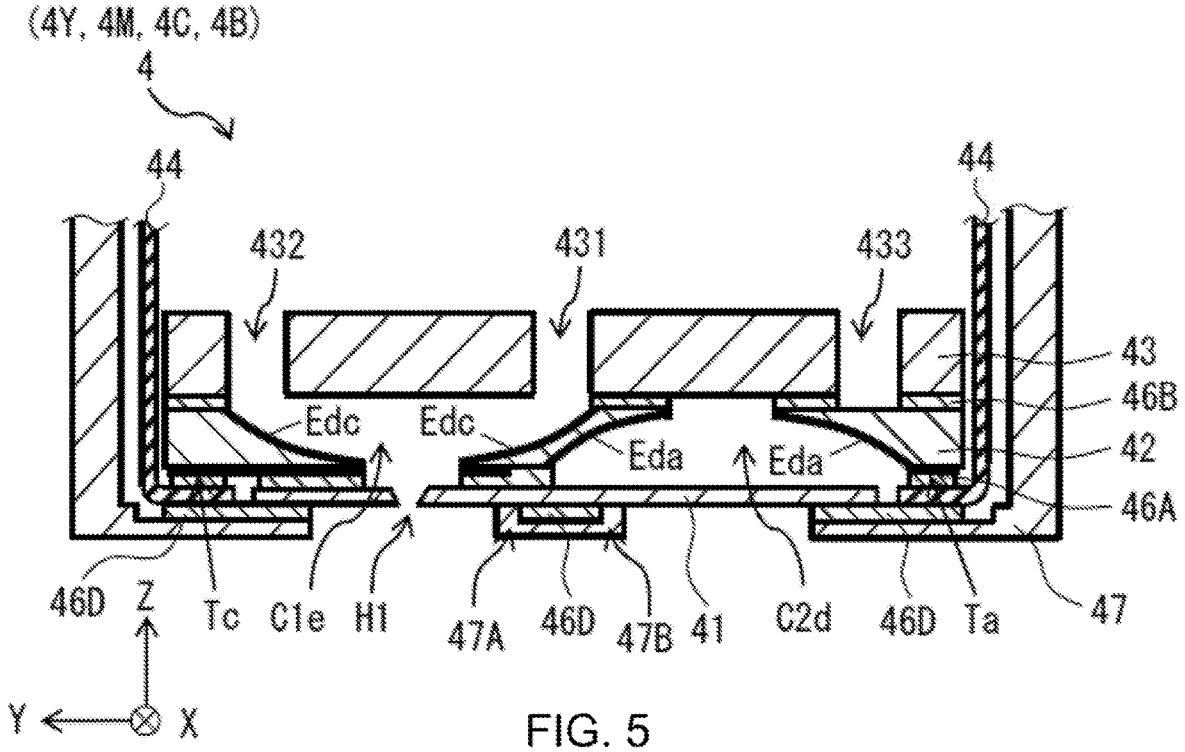
FIG. 5 is a schematic diagram showing a configuration example of the cross-section along the line A-A shown in FIG. 3.
Figure 6:
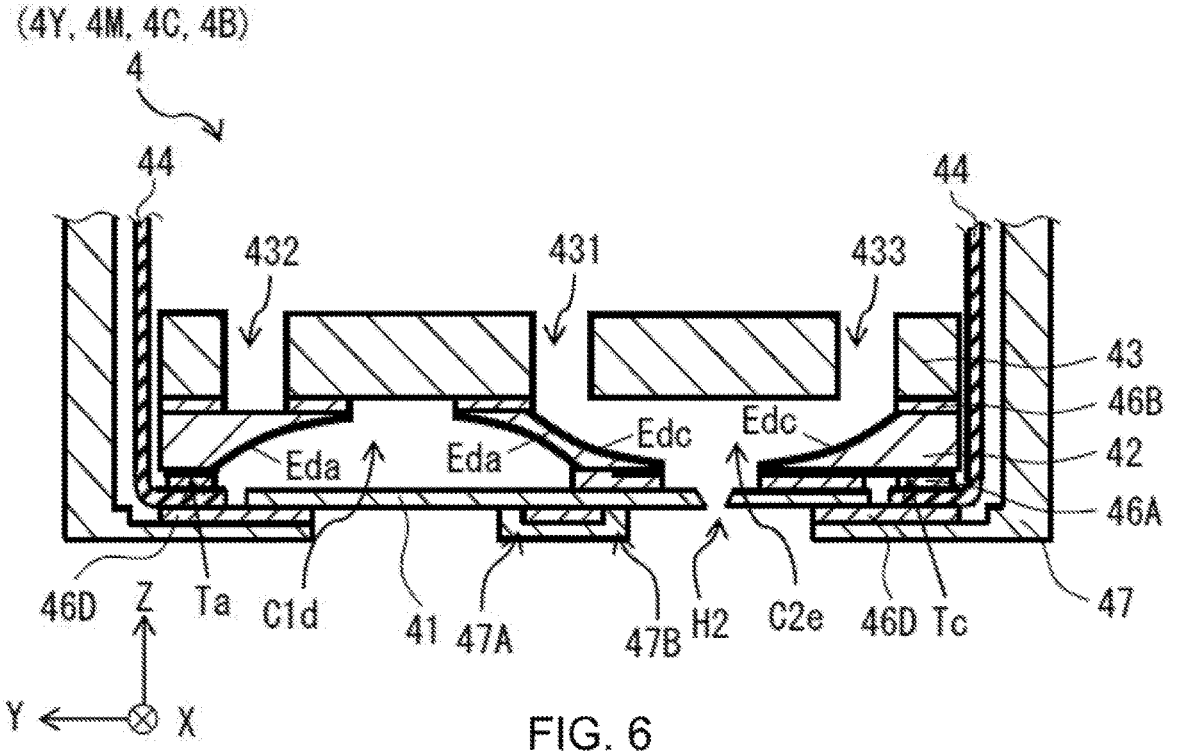
FIG. 6 is a schematic diagram showing a configuration example of the cross-section along the line B-B shown in FIG. 3.
Figure 7:
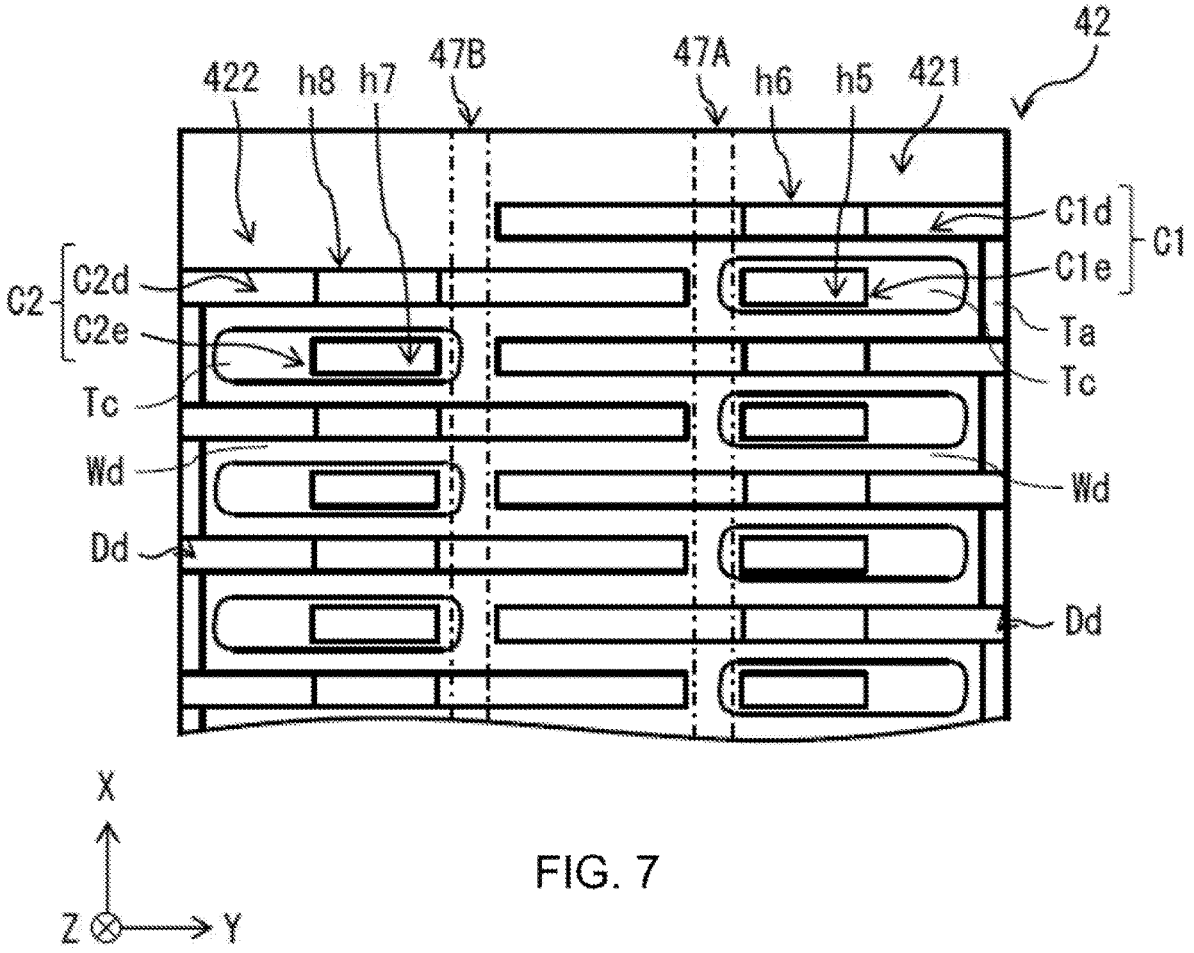
FIG. 7 is a schematic diagram showing an example of a positional relationship between the ejection grooves of the actuator plate and the ribs of the nozzle guard shown in FIG. 3.
Figure 8:
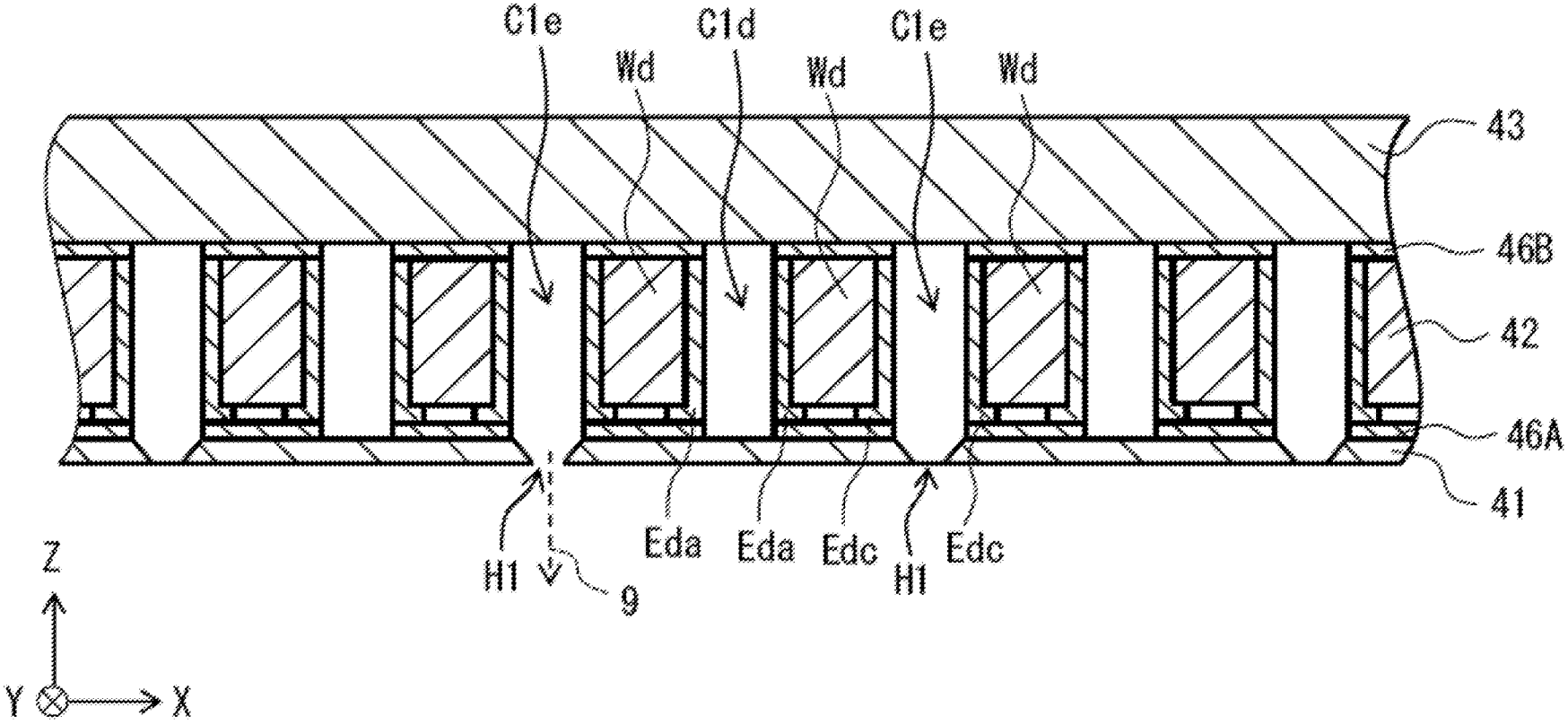
FIG. 8 is a schematic diagram showing a configuration example of a part of the cross-section along the line C-C shown in FIG. 3.

Then, the detailed configuration example of the inkjet heads 4 will be described with reference to FIG. 3 through FIG. 8 in addition to FIG. 1 and FIG. 2. FIG. 3 is an exploded perspective view showing the detailed configuration example of each of the inkjet heads 4. FIG. 4 is a perspective view showing a configuration example of a reverse surface of the actuator plate 42 (described later) shown in FIG. 3. FIG. 5 is a diagram schematically showing a configuration example of the cross-section along the line A-A shown in FIG. 3. FIG. 6 is a diagram schematically showing a configuration example of the cross-section along the line B-B shown in FIG. 3. FIG. 7 is a diagram schematically showing an example of a positional relationship between ejection grooves of the actuator plate 42 and ribs of a nozzle guard 47 (described later). FIG. 8 is a diagram schematically showing a configuration example of a part of the cross-section along the line C-C shown in FIG. 3.

The inkjet heads 4 according to the present embodiment are each an inkjet head of a so-called side-shoot type for ejecting the ink 9 from a central part in the extending direction (the Y-axis direction) of each of a plurality of channels (channels C1, C2) described later. Further, the inkjet heads 4 are each an inkjet head of a circulation type which uses the circulation mechanism 5 (the circulation channel 50) described above to thereby use the ink 9 while circulating the ink 9 between the inkjet head 4 and the ink tank 3.

As shown in FIG. 3, the inkjet head 4 is mainly provided with a nozzle plate 41, the actuator plate 42 and a cover plate 43. The nozzle plate 41, the actuator plate 42 and the cover plate 43 are bonded to each oilier using, for example, an adhesive, and are stacked on one another in this order along the Z-axis direction. It should be noted that the description will hereinafter be presented with the cover plate 43 side along the Z-axis direction referred to as an upper side, and the nozzle plate 41 side referred to as a lower side.

(Nozzle Plate 41)

The nozzle plate 41 is a plate used in the inkjet head 4. The nozzle plate 41 has a resin substrate or a metal substrate having a thickness of, for example, about 50 μm, and is bonded to a lower surface of the actuator plate 42 as shown in FIG. 3. As a material of the resin substrate used as the nozzle plate 41, there can be cited polyimide and so on. As a material of the metal substrate used as the nozzle plate 41, there can be cited stainless steel such as SUS 316 or SUS 304. The nozzle plate 41 is lower in rigidity compared to, for example, the actuator plate 42 and the nozzle guard 47 described later. Further, the nozzle plate 41 is flexible compared to, for example, the actuator plate 42 and the nozzle guard 47. Further, as shown in FIG. 3 and FIG. 4, the nozzle plate 41 has two nozzle columns (nozzle columns 411, 412) each extending along the X-axis direction. These nozzle columns 411, 412 are arranged along the Y-axis direction at a predetermined distance. As described above, the inkjet heads 4 of the present embodiment are each formed as a tow-column type inkjet head.

The nozzle column 411 has a plurality of nozzle holes H1 formed in alignment with each other at predetermined intervals along the X-axis direction. The nozzle holes H1 each correspond to a specific example of a "first nozzle hole" in the present disclosure. These nozzle holes H1 are provided one-to-one to the ejection channels C1*e* described later. These nozzle holes H1 each penetrate the nozzle plate 41 along the thickness direction (the Z-axis direction) of the nozzle plate 41, and are communicated with the respective ejection channels C1*e* in the actuator plate 42 described later as shown in, for example, FIG. 5 and FIG. 6. Specifically, as shown in FIG. 3, each of the nozzle holes H1 is formed so as to be located in a central part along the Y-axis direction below the ejection channel C1*e*. Further, the formation pitch along the X-axis direction in the nozzle holes H1 is arranged to be equal to the formation pitch along the X-axis direction in the ejection channels C1*e*. Although the details will be described later, the ink 9 supplied from the inside of the ejection channel C1*e* is ejected (jetted) from the nozzle hole H1 in such a nozzle column 411.

The nozzle column 412 similarly has a plurality of nozzle holes H2 formed in alignment with each other at predetermined intervals along the X-axis direction. The nozzle holes H2 each correspond to a specific example of a "second nozzle hole" in the present disclosure. These nozzle holes H2 are provided one-to-one to the ejection channels C2*e* described later. Each of these nozzle holes R2 also penetrates the nozzle plate 41 along the thickness direction of the nozzle plate 41, and is communicated with the ejection channel C2*e* in the actuator plate 42 described later as shown in, for example, FIG. 5 and FIG. 6. Specifically, as shown in FIG. 3, each of the nozzle holes H2 is formed so as to be located in a central part along the Y-axis direction below the ejection channel C2*e*. Further, the formation pitch along the X-axis direction in the nozzle holes H2 is arranged to be equal to the formation pitch along the X-axis direction in the ejection channels C2*e*. Although the details will be described later, the ink 9 supplied from the inside of the ejection channel C2*e* is ejected (jetted) also from the nozzle hole H2 in such a nozzle column 412.

(Actuator Plate 42)

The actuator plate 42 is a plate formed of a piezoelectric material such as lead zirconate titanate (PZT). The actuator plate 42 is formed by, for example, a so-called chevron type actuator formed by stacking two piezoelectric substrates different in polarization direction in the thickness direction (the Z-axis direction) on one another. It should be noted that it is also possible for the actuator plate 42 to be a so-called cantilever type actuator formed of a single piezoelectric substrate having the polarization direction set to one direction along the thickness direction (the Z-axis direction). Further, as shown in FIG. 3 and FIG. 4, the actuator plate 42 has two channel columns (channel columns 421, 422) each extending along the X-axis direction. These channel columns 421, 422 are arranged along the Y-axis direction at a predetermined distance. The channel column 421 corresponds to a specific example of a "first groove column" in the present disclosure. The channel column 422 corresponds to a specific example of a "second groove column" in the present disclosure.

As shown in FIG. 3 and FIG. 4, the channel column 421 has the plurality of channels C1 each extending along the Y-axis direction. These channels C1 are arranged side by side so as to be parallel to each other at predetermined intervals along the X-axis direction. Each of the channels C1 is partitioned with drive walls Wd formed of a piezoelectric body (the actuator plate 42), and forms a groove section penetrating the actuator plate 42.

As shown in FIG. 3 and FIG. 4, the channel column 422 similarly has the plurality of channels C2 each extending along the Y-axis direction. These channels C2 are arranged side by side so as to be parallel to each other at predetermined intervals along the X-axis direction. Each of the channels C2 is also partitioned with the drive walls Wd described above, and forms a groove section penetrating the actuator plate 42.

Here, as shown in FIG. 3 and FIG. 4, the channels C1 are configured including the ejection channels C1*e* for ejecting the ink 9, and non-ejection channels C1*d* not ejecting the ink 9. The ejection channels C1*e* each correspond to a specific example of a "first ejection groove" in the present disclosure. The non-ejection channels C1*d* each correspond to a specific example of a "first non-ejection groove" in the present disclosure. In the channel column 421, the ejection channels C1*e* and the non-ejection channels C1*d* are alternately disposed along the X-axis direction. Each of the ejection channels C1*e* is an ejection groove communicated with the nozzle hole H1 in the nozzle plate 41. In other words, each of the ejection channels C1*e* forms the groove section penetrating the actuator plate 42. In contrast, each of the non-ejection channels C1*d* is a non-ejection groove which is not communicated with the nozzle hole H1, and is covered with an upper surface of the nozzle plate 41 from below. Each of the non-ejection channels C1*d* can form a groove section penetrating the actuator plate 42, or can form a groove section having a recessed shape not penetrating the actuator plate 42.

Similarly, the channels C2 are configured including the ejection channels C2*e* for ejecting the ink 9, and non-ejection channels C2*d* not ejecting the ink 9. The ejection channels C2*e* each correspond to a specific example of a "second ejection groove" in the present disclosure. The non-ejection channels C2*d* each correspond to a specific example of a "second non-ejection groove" in the present disclosure. In the channel column 422, the ejection channels C2*e* and the non-ejection channels C2*d* are alternately disposed along the X-axis direction. Each of the ejection channels C2*e* is an ejection groove communicated with the nozzle hole H2 in the nozzle plate 41. In other words, each of the ejection channels C2*e* forms the groove section penetrating the actuator plate 42. In contrast, each of the non-ejection channels C2*d* is a non-ejection groove which is not communicated with the nozzle hole H2, and is covered with an upper surface of the nozzle plate 41 from below. Each of the non-ejection channels C2*d* can form the groove section penetrating the actuator plate 42, or can form the groove section having a recessed shape not penetrating the actuator plate 42.

Further, as shown in FIG. 3, FIG. 4 and FIG. 7, the ejection channels C1*e* and the non-ejection channels C1*d* as the channels C1, and the ejection channels C2*e* and the non-ejection channels C2*d* as the channels C2 are arranged in a staggered manner. Therefore, in each of the inkjet heads 4 according to the present embodiment, the ejection channels C1*e* in the channels C1 and the ejection channels C2*e* in the channels C2 are arranged in a zigzag manner. As shown in FIG. 3, FIG. 4 and FIG. 7, in the actuator plate 42, in the part corresponding to each of the non-ejection channels C1*d*, C2*d*, there is formed a shallow groove section Dd communicated with an outside end part extending along the Y-axis direction in the non-ejection channel C1*d*, C2*d*.

Each of the ejection channels C1*e*, C2*e* and each of the non-ejection channels C1*d*, C2*d* are formed by cutting the piezoelectric substrate using, for example, a dicing blade (also called a diamond blade) obtained by embedding cutting abrasive grains made of diamond or the like on the outer circumference of a disk. Each of the ejection channels C1*e*, C2*e* is formed by cutting the piezoelectric substrate from an upper surface (a surface corresponding to the upper side in the actuator plate 42) toward a lower surface (a surface corresponding to the lower side in the actuator plate 42) using, for example, the dicing blade. Each of the non-ejection channels C1*d*, C2*d* is formed by cutting the piezoelectric substrate from the lower surface toward the upper surface using, for example, the dicing blade.

On this occasion, the cross-sectional shape in the longitudinal direction of each of the ejection channels C1*e*, C2*e* is an inverted trapezoidal shape as shown in, for example, FIG. 5 and FIG. 6. In contrast, the cross-sectional shape in the longitudinal direction of each of the non-ejection channels C1*d*, C2*d* is a trapezoidal shape as shown in, for example, FIG. 5 and FIG. 6. Each of the ejection channels C1*e*, C2*e* is provided with an opening formed on each of the upper surface side and the lower surface side of the actuator plate 42.

The opening h5 of each of the ejection channels C1*e* formed on the lower surface side of the actuator plate 42 is made smaller than the opening h1 of the ejection channel C1*e* formed on the upper surface side of the actuator plate 42 as shown in, for example, FIG. 3, FIG. 4 and FIG. 7. Specifically, the length of the opening h5 of each of the ejection channels C1*e* formed on the lower surface side of the actuator plate 42 is made shorter than the length of the opening h1 of the ejection channel C1*e* formed on the upper surface side of the actuator plate 42 as shown in, for example, FIG. 3, FIG. 4 and FIG. 7.

The opening h7 of each of the ejection channels C2*e* formed on the lower surface side of the actuator plate 42 is made smaller than the opening h4 of the ejection channel C2*e* formed on the upper surface side of the actuator plate 42 as shown in, for example, FIG. 3, FIG. 4 and FIG. 7. Specifically, the length of the opening h7 of each of the ejection channels C2*e* formed on the lower surface side of the actuator plate 42 is made shorter than the length of the opening h4 of the ejection channel C2*e* formed on the upper surface side of the actuator plate 42 as shown in, for example, FIG. 3, FIG. 4 and FIG. 7.

The opening h6 of each of the non-ejection channels C1*d* formed on the lower surface side of the actuator plate 42 is made larger than the opening h2 of the non-ejection channel C1*d* formed on the upper surface side of the actuator plate 42 as shown in, for example, FIG. 3, FIG. 4 and FIG. 7. Specifically, the length of the opening h6 of each of the non-ejection channels C1*d* formed on the lower surface side of the actuator plate 42 is made longer than the length of the opening h2 of the non-ejection channel C1*d* formed on the upper surface side of the actuator plate 42 as shown in, for example, FIG. 3, FIG. 4 and FIG. 7.

The opening h8 of each of the non-ejection channels C2*d* formed on the lower surface side of the actuator plate 42 is made larger than the opening h3 of the non-ejection channel C2*d* formed on the upper surface side of the actuator plate 42 as shown in, for example, FIG. 3, FIG. 4 and FIG. 7. Specifically, the length of the opening h8 of each of the non-ejection channels C2*d* formed on the lower surface side of the actuator plate 42 is made longer than the length of the opening h3 of the non-ejection channel C2*d* formed on the upper surface side of the actuator plate 42 as shown in, for example, FIG. 3, FIG. 4 and FIG. 7.

The ejection channels C1*e* of the channel column 421 and the non-ejection channels C2*d* of the channel column 422 are respectively arranged along the Y-axis direction as shown in, for example, FIG. 3, FIG. 4 and FIG. 7. In this case, a part of a tilted surface on the non-ejection channel C2*d* side out of the pair of tilted surfaces opposed to each other in the longitudinal direction in the ejection channel C1*e*, and a part of a tilted surface on the ejection channel C1*e* side out of the pair of tilted surfaces opposed to each other in the longitudinal direction in the non-ejection channel C2*d* overlap each other when viewed from the thickness direction (the Z-axis direction) of the actuator plate 42. Thus, it is possible to decrease the distance between the ejection channel C1*e* and the non-ejection channel C2*d* while preventing the ejection channel C1*e* and the non-ejection channel C2*d* from being communicated with each other.

Further, the non-ejection channels C1*d* of the channel column 421 and the ejection channels C2*e* of the channel column 422 are respectively arranged along the Y-axis direction as shown in, for example, FIG. 3, FIG. 4 and FIG. 7. In this case, a part of a tilted surface on the ejection channel C2*e* side out of the pair of tilted surfaces opposed to each other in the longitudinal direction in the non-ejection channel C1*d*, and a part of a tilted surface on the non-ejection channel C1*d* side out of the pair of tilted surfaces opposed to each other in the longitudinal direction in the ejection channel C2*e* overlap each other when viewed from the normal direction (the Z-axis direction) of the actuator plate 42. Thus, it is possible to decrease the distance between the non-ejection channel C1*d* and the ejection channel C2*e* while preventing the non-ejection channel C1*d* and the ejection channel C2*e* from being communicated with each other.

Here, as shown in FIG. 3 through FIG. 6 and FIG. 8, drive electrodes Ed extending along the Y-axis direction are disposed on the inner side surfaces opposed to each other in each of the drive walls Wd described above. As the drive electrodes Ed, there exist common electrodes Edc disposed on the inner side surfaces facing the ejection channels C1*e*, C2*e*, and active electrodes Eda disposed on the inner side surfaces facing the non-ejection channels C1*d*, C2*d*. Such drive electrodes Ed (the common electrodes Edc and the active electrodes Eda) are each formed up to the same depth (the same depth in the Z-axis direction) as the drive wall Wd on the inner side surface of the drive wall Wd as shown in, for example, FIG. 8. It should be noted that in the case in which the actuator plate 42 is of the chevron type, the drive electrodes Ed are not necessarily required to be formed up to the same depth as the drive walls Wd in the inner side surfaces of the channels.

Further, the inkjet heads 4 each have a bonding layer 46A for fixing the nozzle plate 41 and the actuator plate 42 to each other between the nozzle plate 41 and the actuator plate 42. The bonding layer 46A is formed of an adhesive. In the case in which the nozzle plate 41 is formed of metal, the bonding layer 46A prevents the electrical short circuit between the drive electrodes Ed and the nozzle plate 41. Further, the inkjet heads 4 each have a bonding layer 46B for fixing the actuator plate 42 and the cover plate 43 to each other between the actuator plate 42 and the cover plate 43. The bonding layer 46B is formed of an adhesive. In the case in which the cover plate 43 is formed of metal, the bonding layer 46B prevents the electrical short circuit between the drive electrodes Ed and the cover plate 43. It should be noted that in the case in which the cantilever type described above is used as the actuator plate 42, each of the drive electrodes Ed (the common electrodes Edc and the active electrodes Eda) is not formed beyond an intermediate position in the depth direction (the Z-axis direction) in the inner side surface of the drive wall Wd.

The pair of common electrodes Edc opposed to each other in the same ejection channel C1*e* (or the same ejection channel C2*e*) are electrically connected to each other in a common terminal Tc. Further, the pair of active electrodes Eda opposed to each other in the same non-ejection channel C1*d* (or the same non-ejection channel C2*d*) are electrically separated from each other. In contrast, the pair of active electrodes Eda opposed to each other via the ejection channel C1*e* (or the ejection channel C2*e*) are electrically connected to each other in an active terminal Ta.

Here, on each of an end edge adjacent to the channel column 421 and an end edge adjacent to the channel column 422 in the actuator plate 42, there is mounted a flexible printed circuit board 44 for electrically connecting the drive electrodes Ed and a control section (a control section 40 described later in the inkjet head 4) to each other. Interconnection patterns (not shown) provided to the flexible printed circuit boards 44 are electrically connected to the common terminals Tc and the active terminals Ta described above. Thus, it is arranged that the drive voltage is applied to each of the drive electrodes Ed from the control circuit 40 described later via the flexible printed circuit board 44.

(Cover Plate 43)

As shown in FIG. 3, the cover plate 43 is disposed so as to close the channels C1, C2 (the channel columns 421, 422) in the actuator plate 42. Specifically, the cover plate 43 is fixed to the upper surface of the actuator plate 42 via the bonding layer 46B, and is provided with a plate-like structure.

As shown in FIG. 3, the cover plate 43 is provided with an entrance side common ink chamber 431 and a pair of exit side common ink chambers 432, 433. Specifically, the entrance side common ink chamber 431 is formed in an area corresponding to the channel column 421 (the plurality of channels C1) and the channel column 422 (the plurality of channels C2) in the actuator plate 42. The exit side common ink chamber 432 is formed in an area corresponding to the channel column 421 (the plurality of channels C1) in the actuator plate 42. The exit side common ink chamber 433 is formed in an area corresponding to the channel column 422 (the plurality of channels C2) in the actuator plate 42.

The entrance side common ink chamber 431 is formed in the vicinity of an inner end part along the Y-axis direction in each of the channels C1, C2, and forms a groove section having a recessed shape. To the entrance side common ink chamber 431, there is coupled a supply side flow channel (not shown) of a flow channel plate, and the ink 9 flows into the entrance side common ink chamber 431 via the supply side flow channel of the flow channel plate. In areas corresponding respectively to the ejection channels C1*e*, C2*e* in the entrance side common ink chamber 431, there are respectively formed supply slits (not shown) penetrating the cover plate 43 along the thickness direction (the Z-axis direction) of the cover plate 43.

As shown in FIG. 3, the exit side common ink chamber 432 is formed in the vicinity of an outer end part along the Y-axis direction in each of the channels C1, and forms a groove section having a recessed shape. To the exit side common ink chamber 432, there is coupled a discharge side flow channel (not shown) of the flow channel plate, and the ink 9 is discharged to the exit side common ink chamber 432 via the discharge side flow channel of the flow channel plate. In areas corresponding respectively to the ejection channels C1*e* in the exit side common ink chamber 432, there are respectively formed discharge slits (not shown) penetrating the cover plate 43 along the thickness direction of the cover plate 43. Similarly, the exit side common ink chamber 433 is formed in the vicinity of an outer end part along the Y-axis direction in each of the channels C2, and forms a groove section having a recessed shape. To the exit side common ink chamber 433, there is coupled a discharge side flow channel (not shown) of the flow channel plate, and the ink 9 is discharged to the exit side common ink chamber 432 via the discharge side flow channel of the flow channel plate. In areas corresponding respectively to the ejection channels C2*e* in the exit side common ink chamber 433, there are also formed discharge slits (not shown) penetrating the cover plate 43 along the thickness direction of the cover plate 43, respectively.

In such a manner, the entrance side common ink chamber 431 and the exit side common ink chambers 432, 433 are each communicated with the ejection channels C1*e*, C2*e* via the supply slits and the discharge slits, respectively, on the one hand, but are not communicated with the non-ejection channels C1*d*, C2*d* on the other hand. Specifically, the non-ejection channels C1*d*, C2*d* are closed by the cover plate 43 on the upper surface of the actuator plate 42.

(Nozzle Guard 47)

As shown in, for example, FIG. 3, the inkjet heads 4 each have the nozzle guard 47 having a plate-like shape disposed so as to cover the nozzle plate 41 and the actuator plate 42 from the lower surface side of the nozzle plate 41.

The nozzle guard 47 is a plate formed to have a rectangular plate-like shape elongated in the X-axis direction so as to correspond to the shape of the actuator plate 42. The nozzle guard 47 is attached to the lower surface of the nozzle plate 41 via a bonding layer 46D formed of an adhesive. In other words, the bonding layer 46D bonds the nozzle plate 41 and the nozzle guard 47 to each other. The bonding layer 46D corresponds to a specific example of a "first bonding layer" and a "second bonding layer" in the present disclosure. On the upper surface (the surface on the nozzle plate 41 side) of the nozzle guard 47, there is erected a peripheral wall part.

The nozzle guard 47 has communication holes H3, H4 for exposing the nozzle holes H1, H2 of the nozzle columns 411, 412 downward at places corresponding respectively to the nozzle columns 411, 412 of the nozzle plate 41. The communication hole H3 corresponds to a specific example of a "first communication hole" in the present disclosure. The communication hole H4 corresponds to a specific example of a "second communication hole" in the present disclosure. The communication hole H3 communicates the nozzle holes H1 and the outside with each other. The communication hole H4 communicates the nozzle holes H2 and the outside with each other. Each of the communication holes H3, H4 is formed to have, for example, an elliptical shape elongated in the X-axis direction.

The nozzle guard 47 further has the ribs 47A, 47B for supporting the nozzle plate 41, and at the same time achieving positioning between the nozzle plate 41 and the nozzle guard 47 (the scanning mechanism 6 by extension). The rib 47A corresponds to a specific example of a "first rib" in the present disclosure. The rib 47B corresponds to a specific example of a "second rib" in the present disclosure. The ribs 47A, 47B each have contact with the lower surface of the nozzle plate 41. The rib 47A is formed along an edge of the communication hole H3, and is formed along, for example, a place adjacent to the communication hole H4 in the edge of the communication hole H3. Meanwhile, the rib 47B is formed along an edge of the communication hole H4, and is formed along, for example, a place adjacent to the communication hole H3 in the edge of the communication hole H4. A predetermined gap is disposed between the rib 47A and the rib 47B. The gap between the rib 47A and the rib 47B is made wider than, for example, the width of the rib 47A or the rib 47B.

The bonding layer 46D is disposed between the nozzle plate 41 and the nozzle guard 47, and bonds, for example, the nozzle plate 41 and the rib 47A to each other, and at the same time bonds the nozzle plate 41 and the rib 47B to each other. It should be noted that the bonding layer 46D can have contact with an upper surface of the rib 47A, and is not required to have contact with the upper surface of the rib 47A. Further, the bonding layer 46D can have contact with an upper surface of the rib 47B, and is nor required to have contact with the upper surface of the rib 47B. The bonding layer 46D is disposed in, for example, the gap between the rib 47A and the rib 47B to separate an area on the nozzle hole H1 side and an area on the nozzle hole H2 side from each other on the lower surface of the nozzle plate 41.

Both of the ribs 47A, 47B have contact with the nozzle plate 41 at positions not opposed to the openings h5 on the nozzle plate 41 side of the ejection channels C1*e*, and positions not opposed to the openings h7 on the nozzle plate 41 side of the ejection channels C2*e*. Specifically, both of the ribs 47A, 47B have contact with an area between the openings h5 of the ejection channels C1*e* and the openings h7 of the ejection channels C2*e* in the lower surface of the nozzle plate 41. The rib 47A has contact with the nozzle plate 41 at positions opposed to the openings h6 on the nozzle plate 41 side of the non-ejection channels C1*d*, and positions not opposed to the openings h8 on the nozzle plate 41 side of the non-ejection channels C2*d*. The rib 47B has contact with the nozzle plate 41 at positions not opposed to the openings h6 on the nozzle plate 41 side of the non-ejection channels C1*d*, and positions opposed to the openings h8 on the nozzle plate 41 side of the non-ejection channels C2*d*.

(Control Section 40)

Here, each of the inkjet heads 4 according to the present embodiment is also provided with the control section 40 for performing control of a variety of operations in the printer 1 as shown in FIG. 2. The control section 40 is arranged to control, for example, a variety of operations in the liquid feeding pumps 52*a*, 52*b* described above and so on besides a recording operation (the jet operation of the ink 9 in the inkjet head 4) of images, characters and so on in the printer 1. Such a control section 40 is formed of, for example, a microcomputer having an arithmetic processing section and a storage section formed of a variety of types of memory.

[Basic Operation of Printer 1]

In the printer 1, the recording operation (a printing operation) of images, characters, and so on to the recording paper P is performed in the following manner. It should be noted that as an initial state, it is assumed that the four types of ink tanks 3 (3Y, 3M, 3C and 3B) shown in FIG. 1 are sufficiently filled with the ink 9 of the corresponding colors (the four colors), respectively. Further, there is achieved the state in which the ink jet heads 4 are filled with the ink 9 in the ink tanks 3 via the circulation mechanism 5, respectively.

In such an initial state, when operating the printer 1, the grit rollers 21 in the carrying mechanisms 2*a*, 2*b* each rotate to thereby carry the recording paper P along the carrying direction d (the X-axis direction) between the grit rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C and 4B) to thereby perform the recording operation of images, characters, and so on to the recording paper P.

[Detailed Operation in Inkjet Heads 4]

Then, the detailed operation (the jet operation of the ink 9) in the inkjet heads 4 will be described with reference to FIG. 1 through FIG. 6 and FIG. 8. Specifically, in the inkjet heads 4 (the side-shoot type, the circulation type inkjet heads) according to the present embodiment, the jet operation of the ink 9 using a shear mode is performed in the following manner.

Firstly, when the reciprocation of the carriage 62 (see FIG. 1) described above is started, a control section 40 applies the drive voltages to the drive electrodes Ed (the common electrodes Edc and the active electrodes Eda) in the inkjet head 4 via the flexible printed circuit boards 44. Specifically, the control section 40 applies the drive voltage to the drive electrodes Ed disposed on the pair of drive walls Wd forming the ejection channel C1*e*, C2*e*. Thus, the pair of drive walls Wd each deform (see FIG. 5, FIG. 6 and FIG. 8) so as to protrude toward the non-ejection channel C1*d*, C2*d* adjacent to the ejection channel C1*e*, C2*e*.

As described above, due to the flexion deformation of the pair of drive walls Wd, the capacity of the ejection channel C1*e*, C2*e* increases. Further, due to the increase in the capacity of the ejection channel C1*e*, C2*e*, it results in that the ink 9 retained in the entrance side common ink chamber 431 is induced into the ejection channel C1*e*, C2*e* (see FIG. 3).

Subsequently, the ink 9 having been induced into the ejection channel C1*e*, C2*e* in such a manner turns to a pressure wave to propagate to the inside of the ejection channel C1*e*, C2*e*. Then, the drive voltage to be applied to the drive electrodes Ed becomes 0 (zero) V at the timing at which the pressure wave has reached the nozzle hole H1, H2 of the nozzle plate 41. Thus, the drive walls Wd are restored from the state of the flexion deformation described above, and as a result, the capacity of the ejection channel C1*e*, C2*e* having once increased is restored again (see FIG. 5).

When the capacity of the ejection channel C1*e*, C2*e* is restored in such a manner, the internal pressure of the ejection channel C1*e*, C2*e* increases, and the ink 9 in the ejection channel C1*e*, C2*e* is pressurized. As a result, the ink 9 having a droplet shape is ejected (see FIG. 5, FIG. 6 and FIG. 8) toward the outside (toward the recording paper P) through the nozzle hole H1, H2. The jet operation (the ejection operation) of the ink 9 in the inkjet head 4 is performed in such a manner, and as a result, the recording operation of images, characters, and so on to the recording paper P is performed. In particular, the nozzle holes H1, H2 of the present embodiment each have the tapered shape gradually decreasing in diameter in the downward direction (see FIG. 5) as described above, and can therefore eject the ink 9 straight (good in straightness) at high speed. Therefore, it becomes possible to perform recording high in image quality.

[Functions and Advantages]

Then, the functions and the advantages in the inkjet head 4 and the printer 1 according to the embodiment of the present disclosure will be described.

The nozzle plate is required to be positioned with respect to the mechanism (the scanning mechanism) for making the inkjet head perform the scanning operation. Therefore, there is developed a technology of providing the rib which protrudes from the nozzle guard toward the nozzle plate to have contact with the nozzle plate. The nozzle plate is fixed to the nozzle guard via an adhesive while having contact with the rib of the nozzle guard.

Here, if the material of the nozzle guard and the material of the actuator plate are different from each other, the expansion deformation amount and the contraction deformation amount due to the variation in heat are also different therebetween. Due to the difference in deformation amount, a stress is applied to the nozzle plate from the actuator plate and the nozzle guard, and thus, a flexure occurs at a part of the nozzle plate having contact with the rib. As a result, the nozzle plate is separated from the actuator plate in some cases. Further, if a warp occurs in the actuator plate, a crack occurs in the actuator plate in some cases. In the case in which the separation of the nozzle plate or the crack in the actuator plate occurs, there is a possibility that ink leakage occurs. Further, in the case of using the ink having electrical conductivity, there is also a possibility that the electrical short circuit is incurred.

In contrast, in the present embodiment, the rib 47A has contact with the nozzle plate 41 at the positions not opposed to the openings h5 on the nozzle plate 41 side of the ejection channels C1*e*. Thus, even in the case in which the flexure occurs at the part having contact with the rib 47A of the nozzle plate 41 due to the fact that the stress caused by the heat when performing the ejection is applied to the nozzle plate 41 from the actuator plate 42 and the nozzle guard 47, it is difficult for the ink leakage from the ejection channels C1*e* to occur. As a result, it is possible to increase the available ink types such as the ink having electrical conductivity.

Further, in the present embodiment, the rib 47A is formed along the edge of the communication hole H3. Thus, it is possible to reduce the possibility of the ink leakage to the gap between the nozzle plate 41 and the nozzle guard 47 using the rib 47A. As a result, it is possible to prevent the ink from being retained in the gap between the nozzle plate 41 and the nozzle guard 47 to thereby reduce the loss of the medium due to dripping of the ink.

Further, in the present embodiment, there is provided the bonding layer 46D for bonding the rib 47A and the nozzle plate 41 to each other. Thus, it is possible to reduce the possibility of the ink leakage to the gap between the nozzle plate 41 and the nozzle guard 47 using the bonding layer 46D. As a result, it is possible to prevent the ink from being retained in the gap between the nozzle plate 41 and the nozzle guard 47 to thereby reduce the loss of the medium due to dripping of the ink.

Further, in the present embodiment, both of the ribs 47A, 47B have contact with the nozzle plate 41 at the positions not opposed to the openings h5 on the nozzle plate 41 side of the ejection channels C1*e*, and the positions not opposed to the openings h7 on the nozzle plate 41 side of the ejection channels C2*e*. Thus, even in the case in which the flexure occurs at the parts having contact with the ribs 47A, 47B of the nozzle plate 41 due to the fact that the stress caused by the heat when performing the ejection is applied to the nozzle plate 41 from the actuator plate 42 and the nozzle guard 47, it is difficult for the ink leakage from the ejection channels C1*e* and the ejection channels C2*e* to occur. As a result, it is possible to increase the available ink types such as the ink having electrical conductivity.

Further, in the present embodiment, there is provided the bonding layer 46D for bonding the rib 47B and the nozzle plate 41 to each other. Thus, it is possible to reduce the possibility of the ink leakage to the gap between the nozzle plate 41 and the nozzle guard 47. As a result, it is possible to increase the available ink types such as the ink having electrical conductivity.

Further, in the present embodiment, the opening h6 of each of the non-ejection channels C1*d* and the opening h8 of each of the non-ejection channels C2*d* extend along the Y-axis direction longer than the opening h5 of each of the ejection channels C1*e* and the opening h7 of each of the ejection channels C2*e*. Thus, since it is possible to increase the capacity of a part closer to the nozzle plate 41 of each of the non-ejection channels C1*d* and the non-ejection channels C2*d*, it is possible to more easily perform the ejection operation of the ejection channels C1*e* and the ejection channels C2*e*. Further, the rib 47A has contact with the nozzle plate 41 at the positions opposed to the openings h6 on the nozzle plate 41 side of the non-ejection channels C1*d*, and the positions not opposed to the openings h8 on the nozzle plate 41 side of the non-ejection channels C2*d*. The rib 47B has contact with the nozzle plate 41 at the positions not opposed to the openings h6 on the nozzle plate 41 side of the non-ejection channels C1*d*, and the positions opposed to the openings h8 on the nozzle plate 41 side of the non-ejection channels C2*d*. Thus, even in the case in which the flexure occurs at the parts having contact with the rib 47A and the rib 47B of the nozzle plate 41 due to the fact that the stress caused by the heat when performing the ejection is applied to the nozzle plate 41 from the actuator plate 42 and the nozzle guard 47, the ink leakage from the non-ejection channels C1*d* and the non-ejection channels C2*d* not filled with the ink does not occur. Therefore, it is possible to increase the available ink types such as the ink having electrical conductivity without hindering the ejection operation.

Further, in the present embodiment, the gap between the rib 47A and the rib 47B is made wider than the width of the rib 47A or the rib 47B. Thus, it is possible to reduce the influence of the stress caused by the heat when performing the ejection on the nozzle plate 41 compared to the case of using, for example, a single rib having a width roughly equivalent to the sum of the widths of the rib 47A and the rib 47B instead of the rib 47A and the rib 47B. As a result, since it becomes difficult for the ink leakage from the ejection channels C1*e* and the ejection channels C2*e* to occur, it is possible to increase the available ink types such as the ink having electrical conductivity.

Further, in the present embodiment, the nozzle plate 41 is lower in rigidity compared to the actuator plate 42 and the nozzle guard 47. In this case, a flexure is apt to occur at a part of the nozzle plate having contact with the rib in the case in which a stress caused by the heat when performing the ejection is applied to the nozzle plate from the actuator plate and the nozzle guard. However, even in such a case, since the first rib has contact at the positions not opposed to the openings on the nozzle plate side of the first ejection grooves, it is difficult for the ink leakage from the actuator plate to occur. As a result, it is possible to increase the available ink types such as the ink having electrical conductivity.

2. MODIFIED EXAMPLES

The disclosure is described hereinabove citing the embodiment, but the disclosure is not limited to the embodiment, and a variety of modifications can be adopted.

Figure 9:
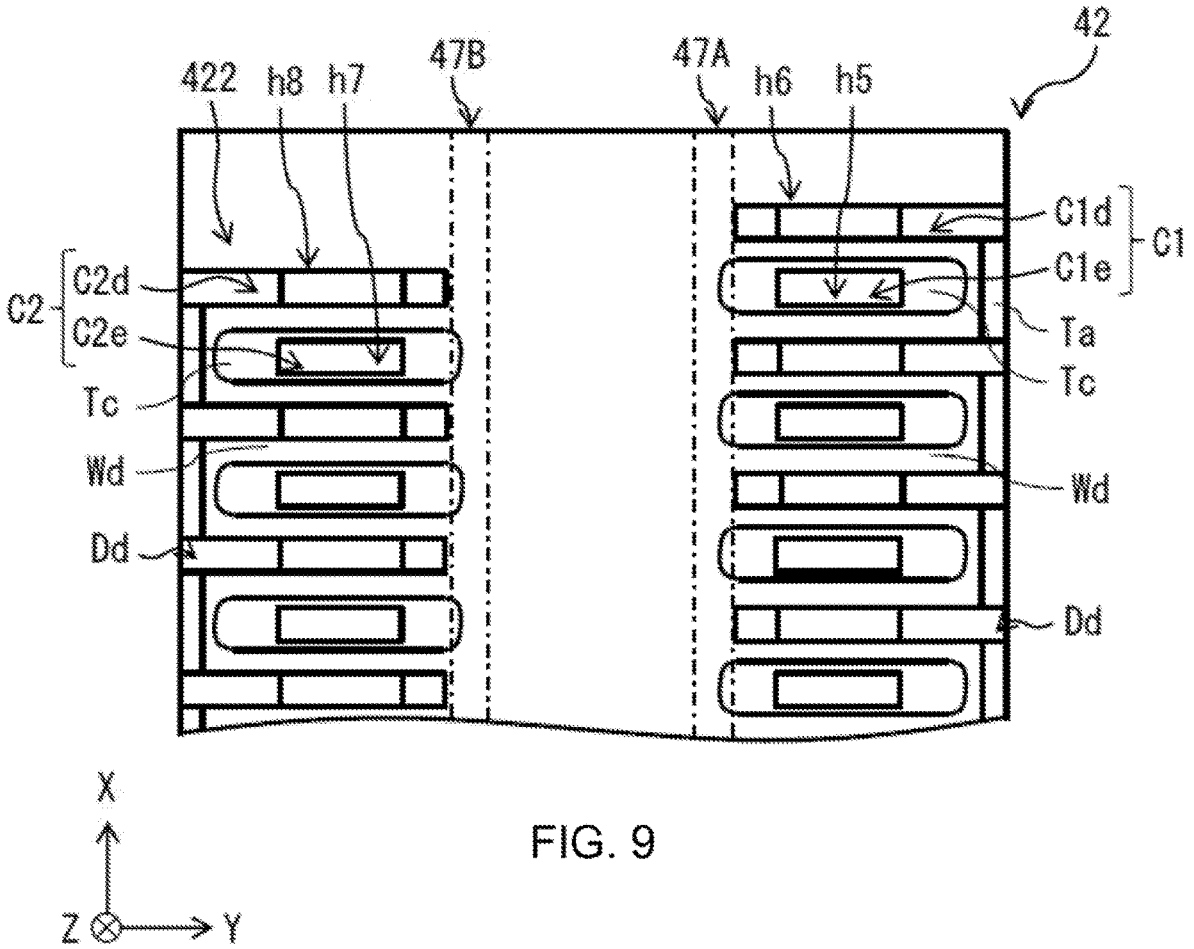
FIG. 9 is a schematic diagram showing a modified example of the positional relationship between the ejection grooves of the actuator plate and the ribs of the nozzle guard shown in FIG. 3.

For example, in the embodiment described above, it is also possible for both of the ribs 47A, 47B to have contact at the positions not opposed to the openings h6 on the nozzle plate 41 side of the non-ejection channels C1*d*, and the positions not opposed to the openings h8 on the nozzle plate 41 side of the non-ejection channels C2*d* as shown in, for example, FIG. 9. On this occasion, it is also possible for the length in the longitudinal direction of the openings h6 and the openings h8 to become roughly equal to the length in the longitudinal direction of the openings h5 and the openings h7 as shown in, for example, FIG. 9. Thus, even in the case in which the flexure occurs at the parts having contact with the ribs 47A, 47B of the nozzle plate 41 due to the fact that the stress caused by the heat when performing the ejection is applied to the nozzle plate 41 from the actuator plate 42 and the nozzle guard 47, it is difficult for the ink leakage from the ejection channels C1*e* and the ejection channels C2*e* to occur. As a result, it is possible to increase the available ink types such as the ink having electrical conductivity.

Further, for example, in the embodiment described above, the description is presented specifically citing the configuration examples (the shapes, the arrangements, the number and so on) of each of the members in the primer 1 and the inkjet head 4, but what is described in the above embodiment is not a limitation, and it is possible to adopt other shapes, arrangements, numbers and so on. Further, the values or the ranges, the magnitude relation and so on of a variety of parameters described in the above embodiment are not limited to those described in the above embodiment, but can also be other values or ranges, other magnitude relation, and so on.

Specifically, for example, in the embodiment described above, the description is presented citing the inkjet head 4 of the two column type (having the two nozzle columns 411, 412), but the example is not a limitation. Specifically, for example, it is also possible to adopt an inkjet head of a single-column type (having a single nozzle column), or an inkjet head of a multi-column type (having three or more nozzle columns) with three or more columns.

Further, for example, in the embodiment described above, there is described the case in which the nozzle columns 411, 412 each extend linearly along the X-axis direction, but this example is not a limitation. It is also possible to arrange that, for example, the nozzle columns 411, 412 each extend in an oblique direction. Further, the shape of each of the nozzle holes H1, H2 is not limited to the circular shape as described in the above embodiment, but can also be, for example, a polygonal shape such as a triangular shape, an elliptical shape, or a start shape.

Further, for example, although the case in which the side shoot type is adopted in the inkjet heads 4 is described in the above embodiment, this example is not a limitation, and it is also possible to, for example, adopt other types in the inkjet heads 4. Further, for example, although the case in which the circulation type is adopted in the inkjet heads 4 is described in the above embodiment, this example is not a limitation, and it is also possible to, for example, adopt other types without the circulation in the inkjet heads 4.

Further, the series of processes described in the above embodiment can be arranged to be performed by hardware (a circuit), or can also be arranged to be performed by software (a program). In the case of arranging that the series of processes is performed by the software, the software is constituted by a program group for making the computer perform the functions. The programs can be incorporated in advance in the computer described above, and are then used, or can also be installed in the computer described above from a network or a recording medium and are then used.

Further, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange to apply the "liquid jet head" (the inkjet head 4) and the "jet hole plate" (the nozzle plate 41) of the present disclosure to other devices than the inkjet printer. Specifically, for example, it is also possible to arrange to apply the "liquid jet head" or the "jet hole plate" of the present disclosure to a device such as a facsimile or an on-demand printer.

Further, although the recording object of the printer 1 is the recording paper P in the embodiment and the modified example described above, the recording object of the "liquid jet recording device" according to the present disclosure is not limited to the recording paper P. It is possible to form characters and patterns by jetting the ink to a variety of materials such as cardboard, cloth, plastic or metal. Further, the recording object is not required to have a flat shape, and it is also possible to perform painting or decoration of a variety of 3D objects such as food, architectural materials such as a tile, furniture, or a vehicle. Further, it is possible to print fabric with the "liquid jet recording device" according to the present disclosure, or it is also possible to perform 3D shaping by solidifying the ink after jetted (so-called a 3D printer).

Further, it is also possible to apply the variety of examples described hereinabove in arbitrary combination.

It should be noted that the advantages described in the specification are illustrative only but ate not a limitation, and other advantages can also be provided.

Further, the present disclosure can also take the following configurations.

What is claimed is:

1. A liquid jet head comprising:

an actuator plate having a plurality of first ejection grooves;

a nozzle plate having first nozzle holes communicated with the first ejection grooves; and a nozzle guard having a first rib adapted to support the nozzle plate, and a first communication hole adapted to communicate each of the first nozzle holes and an outside with each other, wherein the first rib has contact with the nozzle plate at a position which fails to be opposed to an opening on the nozzle plate side of each of the first ejection grooves.

2. The liquid jet head according to claim 1, wherein the first rib is formed along an edge of the first communication hole.

3. The liquid jet head according to claim 2, further comprising:

a first bonding layer adapted to bond the first rib and the nozzle plate to each other.

4. The liquid jet head according to claim 1, wherein the actuator plate further includes a plurality of second ejection grooves, the nozzle plate further includes second nozzle holes communicated with the second ejection grooves, the nozzle guard further includes a second rib adapted to support the nozzle plate, and a second communication hole adapted to communicate each of the second nozzle holes and the outside with each other, and both of the first rib and the second rib have contact with the nozzle plate at a position which fails to be opposed to an opening on the nozzle plate side of each of the first ejection grooves, and a position which fails to be opposed to an opening on the nozzle plate side of each of the second ejection grooves.

5. The liquid jet head according to claim 4, further comprising:

a second bonding layer adapted to bond the second rib and the nozzle plate to each other.

6. The liquid jet head according to claim 4, wherein the actuator plate has a first groove column in which the plurality of first ejection grooves and a plurality of first non-ejection grooves are alternately arranged in a first direction, and a second groove column in which the plurality of second ejection grooves and a plurality of second non-ejection grooves are alternately arranged in the first direction, the first groove column and the second groove column are disposed so as to be opposed to each other via a predetermined gap in a second direction crossing the first direction, the first ejection grooves and the second ejection grooves each extend in the second direction, the first non-ejection grooves and the second non-ejection grooves each extend in the second direction longer than the first ejection grooves and the second ejection grooves, the first rib has contact with the nozzle plate at a position opposed to an opening on the nozzle plate side of each of the first non-ejection grooves, and a position which fails to be opposed to an opening on the nozzle plate side of each of the second non-ejection grooves, and the second rib has contact with the nozzle plate at a position which fails to be opposed to an opening on the nozzle plate side of each of the first non-ejection grooves, and a position opposed to an opening on the nozzle plate side of each of the second non-ejection grooves.

7. The liquid jet head according to claim 6, wherein the gap between the first rib and the second rib is wider than a width of one of the first rib and the second rib.

8. The liquid jet head according to claim 4, wherein the actuator plate has a first groove column in which the plurality of first ejection grooves and a plurality of first non-ejection grooves are alternately arranged in a first direction, and a second groove column in which the plurality of second ejection grooves and a plurality of second non-ejection grooves are alternately arranged in the first direction, the first groove column and the second groove column are disposed so as to be opposed to each other via a predetermined gap in a second direction crossing the first direction, and both of the first rib and the second rib are disposed in the gap, and further have contact with the nozzle plate at a position which fails to be opposed to an opening on the nozzle plate side of each of the first non-ejection grooves, and a position which fails to be opposed to an opening on the nozzle plate side of each of the second non-ejection grooves.

9. The liquid jet head according to claim 1, wherein the nozzle plate is lower in rigidity compared to the actuator plate and the nozzle guard.

10. A liquid jet recording device comprising:

the liquid jet head according to claim 1; and a containing section adapted to contain a liquid to be supplied to the liquid jet head.

* * * * *